US006065956A

United States Patent [19]

Cornil et al.

[11] Patent Number: 6,065,956

[45] Date of Patent: May 23, 2000

[54] UNIVERSAL MIXER DEVICE FOR MIXING TWO GASEOUS FLUIDS

[75] Inventors: Jean-Philippe Cornil, Houilles; Frédéric Vulovic, Savigny sur Orge, both of France

[73] Assignee: Gaz de France, France

[21] Appl. No.: 09/187,079

[22] Filed: Nov. 6, 1998

[30] Foreign Application Priority Data

Nov. 7, 1997 [FR] France ..... 97 14025

[51] Int. Cl.[7] ..... F23N 5/00

[52] U.S. Cl. ..... 431/90; 431/186; 431/187; 431/353

[58] Field of Search ..... 431/8, 12, 89, 431/90, 186, 187, 188, 350, 353, 354

[56] References Cited

U.S. PATENT DOCUMENTS

| | | | |
|---|---|---|---|
| 4,793,798 | 12/1988 | Sabin | 431/187 |
| 4,902,222 | 2/1990 | Van Belle | 431/186 |
| 4,976,607 | 12/1990 | Grimard | 431/187 |

FOREIGN PATENT DOCUMENTS

| | | |
|---|---|---|
| 0316454 | 5/1989 | European Pat. Off. . |
| 0578578 | 1/1994 | European Pat. Off. . |
| 2341131 | 9/1977 | France . |
| 2514163 | 4/1983 | France . |

OTHER PUBLICATIONS

Patent Abstracts of Japan, vol. 9, No. 124 (M–383), May 29, 1985 and JP 60008456 A (Nissan Jidosha KK), Jan. 17, 1985, title Fuel Supply Device for Internal–Combustion Engine.

*Primary Examiner*—James C. Yeung
*Attorney, Agent, or Firm*—Ostrolenk, Faber, Gerb & Soffen, LLP

[57] ABSTRACT

The universal mixer device for mixing two gaseous fluids comprises an enclosure defining coaxial chambers, ducts opening out respectively into each of the chambers to feed them with two gases at medium pressure, and sonic nozzles each comprising a hollow converging-diverging body of revolution serving as seats for respective cone-shaped valve members. The valve member of one of the nozzles has an axial bore and defines the chambers at least in part. The other nozzle is disposed inside the axial bore. The hollow converging-diverging bodies of revolution occupy positions that are determined relative to the enclosure, and the valve members are mechanically linked to each other and are associated with a single actuator. The gases that have passed through the coaxial and geometrically similar nozzles flow into a common downstream chamber in which the gases mix with a predetermined mixing ratio determined by the dimensions of the nozzles.

13 Claims, 4 Drawing Sheets

UNIVERSAL MIXER DEVICE FOR MIXING TWO GASEOUS FLUIDS

The present invention relates to a universal mixer device for mixing two gaseous fluids, and to the use thereof to various types of installation for feeding mixtures of air and of fuel gas.

BACKGROUND OF THE INVENTION

It is often necessary to mix two different gases together.

In particular, the use of fuel gases such as natural gas or liquefied petroleum gas (LPG) requires a process of mixing with air. Mixing is generally performed at pressures close to atmospheric pressure.

In such applications, the fuel gas, which is often available at medium pressure, is expanded to a few millibars in order to be put into contact with the oxidizing gas which is generally atmospheric air.

A defect of the numerous mixer devices that are presently in use lies in the narrow operating ranges over which they can maintain the best possible operating conditions. Thus, when feeding burners or carburetors, it is rare for combustion to be stoichiometric over the entire range of use of the installation. Similarly, with generators that generate a mixture of air and LPG, the calorific value of the gas delivered suffers from the inaccuracy of mixer devices which at present provide a dynamic range that rarely exceeds 10:1.

Existing mixer devices include the following:

- discrete-action systems in which the air/gas mixing is preadjusted by orifices of through section and feed pressure that are predefined in such a manner as to obtain the looked-for combustion in a burner or a constant higher calorific value (HCV) in a generator of a mixture of air and LPG. Such devices are in widespread use, in particular for the burners of high and medium power boilers which have systems that are preset for one, two, or three operating rates;
- modulating systems in which the sir/gas mixture is kept constant by the combined action of two valves that open synchronously, one for gas and the other for air. Such systems are likewise preadjusted, by means of mechanical cam devices, which make it possible to set the desired mixture for each position of the valve. The same principle is to be found in generators for generating a mixture of air and LPG; and
- modulating systems controlled by controllers and computers in which action is taken on gas and air admission valves on the basis of one or more measurements (flue gas analysis, temperature of a process, gas flow rate, etc.).

In the case of generators that generate a mixture of air and LPG, e.g. air/propane mixers, two different techniques are presently known. The so-called high or medium pressure technique uses compressed air and LPG at a pressure of a few bars, and it is capable of delivering powers that are quite high. The second or "low pressure" system uses atmospheric air and LPG at a pressure of a few bars.

Mixers for use with a distribution network operating at medium pressure (e.g. 2 bars) use compressed air and LPG at a pressure that generally lies in the range 4 bars to 10 bars. Such known mixers have a first line for feeding compressed air and a second line for feeding LPG.

The two lines come together in a manifold where mixing takes place prior to delivery at a pressure lying in the range a few millibars to 1 or 2 bars. The pressure limit is associated with the danger of LPG condensing when the weather conditions at the delivery site drop to low temperatures.

The mixing ratio is obtained by means of pneumatically-controlled proportional valves. Each line is fitted with a regulator valve controlled by a pneumatic device which gives rise to a simultaneous reaction of both valves, which valves are of sections and of opening relationships that are predefined. Recent systems make use of servo-control which, while maintaining the previous architecture, makes it possible significantly to improve the performance of a mixer of this type in terms of HCV accuracy and in terms of dynamic range. Such servo-control makes use of information concerning instantaneous flow rate as delivered by spinner meters disposed in each line, and information from a Wobbemeter which acts on the ratio setting. A controller associated with a computer serves to handle the various parameters.

Those various systems share the following defects:

- small dynamic range for flow rates over which the HCV is stable, since dynamic range depends in most cases on the dynamic range of the meter which rarely exceeds 20:1;
- it is difficult to stabilize pressure regulation, particularly at low pressure, since the control system needs to govern continuously the precise positions of two valves (one for air and the other for LPG);
- they are unsuitable for regimes in which variations are fast because of the relatively long response times due to the two valves under control;
- installations consume large quantities of energy (it is necessary to have an air compressor, and both fluids need to be heated in order to avoid recondensation phenomena); and
- installations are complex, and as a result very expensive, and they require specialist personnel for maintenance and adjustment.

Generators for generating mixtures of air and LPG for low pressure applications generally, make use of a battery of Venturi nozzles providing unit flow rates that can be combined to generate an arithmetic progression (e.g.: 10–20–40–80 $m^3/h$) so as to provide regulation in discrete steps. Mixing is obtained by sucking in atmospheric air, by the induction effect of the LPG jet which draws the air into the nozzle. The on/off mode of operation of the various nozzles makes it necessary to use buffer gasholders to "smooth" the resulting pressure in the network.

The advantage of that type of generator is that it does not require a supply of energy since it operates solely by using the pressure of the LPG.

The drawbacks are associated with the need to have a gasholder, which by its nature is bulky and expensive, in order to regulate pressure which would otherwise be unstable because of the cyclical operation of the nozzles. Finally, the precision obtained in terms of HCV is low since installations of that type generally have nozzles which are adjusted once and forever without making use of devices for implementing pressure and temperature corrections.

OBJECTS AND BRIEF SUMMARY OF THE INVENTION

The present invention seeks to remedy the drawbacks of the prior art and to enable two gaseous fluids to be mixed in a manner that is convenient, simple, and reliable, and to do so over a large dynamic range.

According to the invention, these objects are achieved by a universal mixer device for mixing two gaseous fluids, wherein:

the device comprises: an enclosure defining first and second coaxial chambers; a first duct opening out into the first chamber to feed it with a first gas at medium pressure; a second duct opening out into the second chamber to feed it with a second gas at medium pressure; a first sonic nozzle having a throat of varying section disposed in the first chamber; and a second sonic nozzle having a throat of varying section disposed in the second chamber;

the first sonic nozzle comprises a first hollow converging-diverging body of revolution serving as a seat for a first cone-shaped valve member, and the second sonic nozzle comprises a second hollow converging-diverging body of revolution serving as a seat for a second cone-shaped valve member;

the first valve member has an axial bore and defines at least a portion of the first and second chambers;

the second sonic nozzle is disposed inside said axial bore;

the first and second hollow converging-diverging bodies of revolution are of determined position relative to the enclosure while the first and second valve members are mechanically linked to each other and are associated with a single actuator ensuring synchronized displacement of the first and second valve members; and the first and second gases after passing through the coaxial and geometrically similar first and second sonic nozzles flow axially into a common downstream chamber in which the first and second gases mix in a predetermined mixing ratio determined by the dimensions of the first and second sonic nozzles.

Each of the first and second gases is admitted into the respective first or second chamber at a pressure that is equal to or greater than 1.3 bars.

Because the first and second nozzles are geometrically similar, and given that they have valve members which are mechanically linked together, and that they are moved accurately and synchronously by means of a single actuator, the air and gas flow rates are caused to vary continuously in such a manner that the ratio between them is kept constant over the entire operating range. The operating dynamic range can, for example, be of the order of 50:1.

In a particular embodiment, the universal mixing device for mixing two fluids further comprises, inside the enclosure, a third chamber communicating via orifices with the first chamber, and a third sonic nozzle having a throat of varying section disposed in She third chamber; the third sonic nozzle comprises a third hollow converging-diverging body of revolution identical to said first hollow body of revolution, in axial alignment therewith but in the opposite direction thereto in a position that is determined relative to the enclosure, and serving as a seat for a third cone-shaped valve member whose shape and dimensions are identical to those of the first valve member; the third valve member is mechanically linked to the first and second valve members, but is disposed in the opposite direction relative thereto such that the third sonic nozzle operates antagonistically relative to the first sonic nozzle with the third sonic nozzle being in its open position when the first sonic nozzles is in its closed position, and vice versa; and the third chamber has orifices disposed downstream from the third sonic nozzle enabling surplus first gas from the third sonic nozzle to be exhausted from the enclosure.

The first gas is admitted into the first chamber at a pressure that is greater than or equal to 150 millibars and the second gas is admitted into the second chamber at a pressure that greater than or equal to 1.3 bars.

Advantageously, each of the sonic nozzles is made in modular manner and includes a valve member that can be dismounted, thereby enabling the capacity or the mixing ratio of the mixer device to be modified by changing the cone angle of the valve member. The fixed portions of the sonic nozzles can themselves also be made in dismountable manner.

The presence of a third nozzle that is antagonistic relative to the first nozzle, and that has functional characteristics that are identical thereto, makes it possible to provide automatic regulation of the pressure of the first gas, regardless of the position occupied by the mixer, and makes it possible to operate on gases that are at relatively low pressures (a few tens of millibars to a few hundreds of millibars).

BRIEF DESCRIPTION OF THE DRAWINGS

Other characteristics and advantages of the invention, and other applications of the universal mixer device of the invention appear from the following description of particular embodiments, given as examples, and with reference to the accompanying drawings, in which.

MORE DETAILED DESCRIPTION

Figure 1:
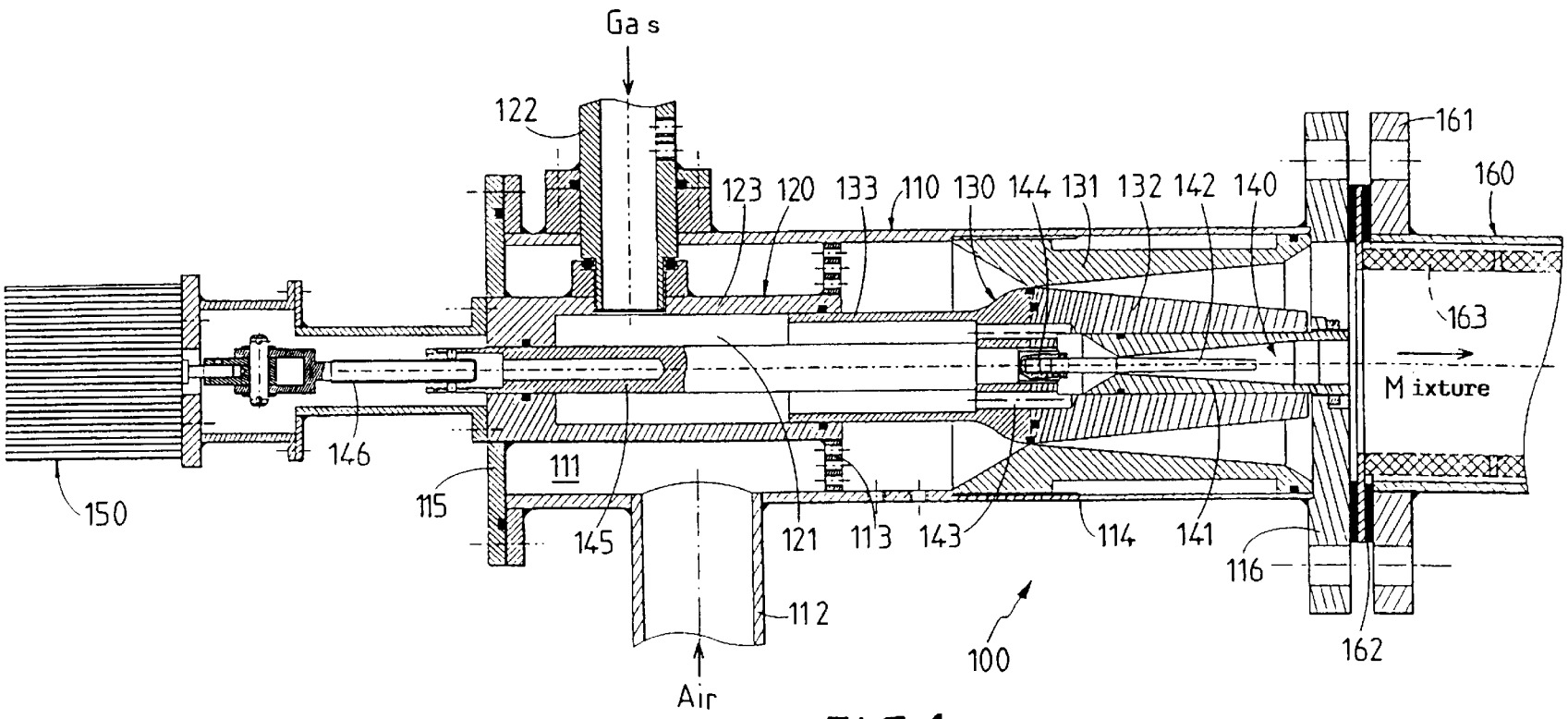
FIG. 1 is an axial section view of a first embodiment of the gas mixer device of the invention, having two sonic nozzles.

In the example of FIG. 1, which is applied to mixing air and a fuel gas, the mixer device 100 comprises a cylindrical enclosure 110 having defined therein two coaxial chambers 111 and 121. A lateral oxidizing air feed duct 112 opens out into the outer chamber 111 and a lateral fuel gas feed duct opens out into the inner chamber 121.

A first sonic nozzle 130 having a throat of varying section is disposed in the first chamber 111, downstream from a perforated plate 113 serving to straighten out the flow of air injected by the duct 112 into the chamber 111. The nozzle 130 comprises a hollow converging-diverging body of revolution 131 which serves as a seat for a cone-shaped valve member 132.

A second sonic nozzle 140 with a throat of varying section is placed inside the valve member 132 of the first nozzle 130. The nozzle 140 comprises a hollow converging-diverging body of revolution 141 which is secured to the enclosure 110 by means of a bracket 116 and is placed inside a bore through the valve member 132 and is in contact with the bore via an O-ring so as to allow the valve member 132 to slide relative to the hollow body 131 in leakproof manner relative to the hollow body 141. The hollow body 141 serves as a seat for a cone-shaped valve member 142 whose upstream end 144 is threaded to enable it to be selectively secured to threads formed in the valve member 132. The valve members 132 and 142 are thus secured to each other and are connected to the downstream end of an axial control rod 145 itself connected via a coupling mechanism 146 to an actuator 150, which may be of the pneumatic, electric, or hydraulic type.

The ability of the cone-shaped valve members 132 and 142 to be dismantled makes the device modular. Thus, merely by replacing the valve members 132 and 142 with valve members having different conicities, it is possible to modify the capacity or the ratio of the mixer device. The fixed hollow body 131 which is screwed into the tubular enclosure 110 is also easy to replace.

The upstream portion 133 of the valve member 132 is in the form of a hollow cylinder and is engaged so as to be capable of sliding axially in sealed manner along the bore of a cylinder 123 which constitutes a wall between the central fuel gas feed chamber 121 and the outer annular oxidizing air feed chamber 111. The fuel gas injected via the radial duct 122 into the chamber 121 can penetrate into the hollow upstream portion 133 of the valve 132 and can penetrate into the converging-diverging space of the nozzle 140 through passage(s 143 formed in the valve member 132.

The enclosure 110 of the mixer device may be in the form of a sleeve having an outer cylindrical wall 114 and flange-forming transverse plane end walls 115 and 116. The downstream end wall 116 which serves in particular as a support for the fixed but dismountable portion 141 of the nozzle 140 can be connected to the upstream flange 161 of an element defining a mixing chamber and receiving both the fuel gas flow emerging from the diverging space of the internal sonic nozzle 140 and the air flow emerging from the annular diverging space of the outer sonic nozzle 130. The inside wall of the downstream mixing chamber 160 can be fitted with sound absorbing material 163. The material 163 and similar material 162 inserted between the flange-forming elements 116 and 161 of the enclosure 110 and of the downstream mixing chamber 160 together constitute a silencer device at the outlet from the two coaxial nozzles 130 and 140, which silencer device reduces sound emission associated with expansion and promotes stirring of the mixture.

It will be observed that in the prior art, sonic nozzles with throats of varying section are generally used in a gas feed line to perform the three functions of expanding the gas, measuring the gas flow rate, and regulating the gas flow rate or the calorific value conveyed by a fuel gas.

Examples of flow rate measuring and regulating apparatuses implementing sonic nozzles having varying throats are given, for example, in the following documents FR-A-2 341 131, FR-A-2 514 163, FR-A-2 580 803, and FR-A-2 630 184. The sonic nozzle technology described in the above-specified documents is applicable to the mixer device of the invention. In the prior art, when using coaxial nozzles as in document FR-A-2 514 163, the same gas is fed to both nozzles. The central auxiliary nozzle serves merely to receive a small flow bled from the main flow of gas that is to be regulated, and the auxiliary nozzle opens out into a distinct duct leading to a meter. Although the architecture described in document FR-A-2 514 163 thus has no function involving the mixing of gases of different kinds, it is nevertheless possible in the context of the present invention to use the technology for manufacturing sonic nozzles as known in particular from the above-specified documents.

The device of FIG. 1 is not limited to mixing air and fuel gas, and can be applied to various pairs of gaseous fluids. Nevertheless, advantageous applications exist when the first gas admitted into the duct 112 is air and the second gas admitted into the duct 122 is a fuel gas such as a natural gas or a petroleum gas such as propane, butane, or a mixture of propane and of butane.

To obtain sonic flow conditions in the throats of the nozzles 130 and 140, it is necessary for the air and the gas admitted into the ducts 112 and 122 to have a minimum absolute pressure of 1.3 bars.

Fuel gases are generally delivered at a pressure in the range 1.3 bars to 4 bars for natural gas and 2 bars to 7 bars for LPG. In which case, there is no need to insert a pressure booster between the source of fuel gas and the gas inlet 122. In contrast, a source of compressed air at medium pressure is not always available. When atmospheric air is applied via a fan whose delivery pressure lies, for example, in the range 20 mbar to 50 mbar, it is necessary to interpose a pressure booster between the fan and the air inlet 112, or else to implement a three-nozzle mixer device such as the device described below with reference to FIG. 2.

The sizes and shapes of the nozzles 130 and 140 (in particular the cone angles of the valve members 132 and 142 and of the converging-diverging fixed parts 131 and 141) are initially defined to obtain a flow section ratio which, to a first approximation, corresponds to the desired mixing ratio. Thus, by way of example, in an application to generating a mixture of air and propane, the mixing ratio may be 30% LPG and 70% air. This ratio is determined while taking account of the feed pressure conditions and of the desired maximum power.

Starting from predefined initial conditions for the shapes of the nozzles, which condition, can easily be adapted or modified given the modular design of the sonic nozzles, the effect of displacing the two valve members 132 and 142 in the nozzles 130 and 140 by means of the actuator 150 is to provide continuous variation in the flow rates of air and of gas, with the ratio between them being kept constant over the entire operating range because the two nozzles 130 and 140 are geometrically similar. It is thus possible to obtain operating dynamic ranges that are much greater than those of known systems, e.g. 50:1.

The gas mixer device of the invention as described with reference to FIG. 1 can be used in the context of various applications.

In a particular application, the mixer of the invention can be integrated in an installation for feeding a mixture of air and fuel gas to an industrial process such as a multiple-burner furnace for heat treatment.

In certain heat treatment furnaces, a plurality of burners are spaced apart inside the furnace. If the various burners are fed from a conventional air-gas mixer, when the air modifies the flow rate of one or more burners in the furnace, then the initial power and thus the quality of the mixture are affected.

In contrast, with the present invention, it is possible to implement a sonic-nozzle air-gas mixer in which any modification to the flow rates of one or more burners in the furnace gives rise automatically to a transfer of flow rate, up or down, towards the non-modified burners, thereby keeping both the total power of the furnace and the quality of the mixture unchanged.

Figure 3:
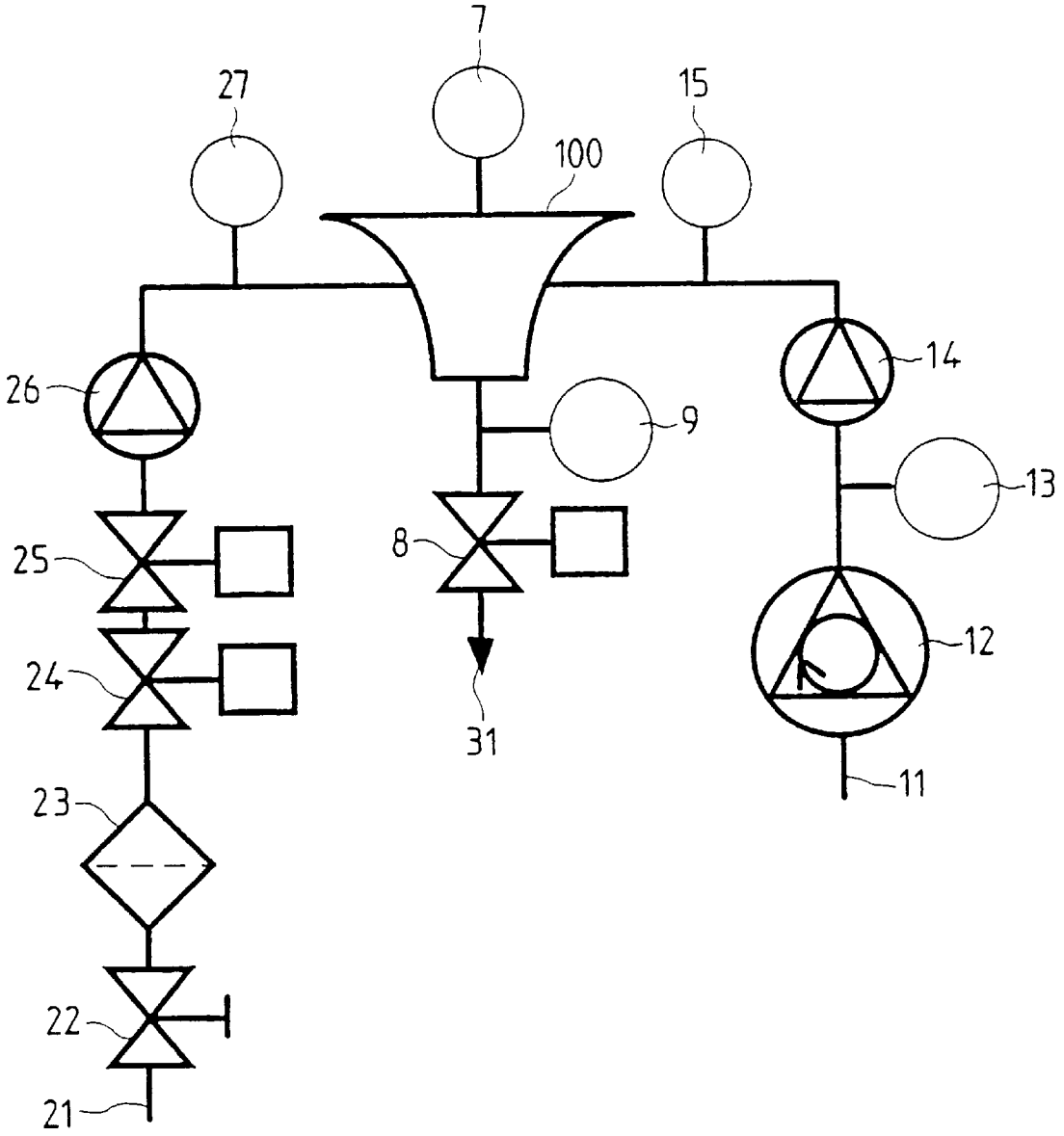
FIG. 3 is a diagram showing an example of how a mixer of the invention can be installed.

FIG. 3 shows an example of an installation incorporating a mixer of the invention that can be used as an example of feeding an air-gas mixture to an industrial process such as a set of burners in the same furnace, in which the various burners can be adjusted to produce flames having a very wide variety of shapes and characteristics without that influencing the quality of the air-gas mixture applied to the various burners.

In the installation of FIG. 3, there can be seen a line 11 for supplying compressed air and a line 21 for supplying fuel gas at medium pressure, in excess of 1.3 bars.

In the air supply line 11, a fan 12 is associated with a low pressure pressotat 13, a pressure regulator 14, and instruments 15 for measuring pressure and temperature. The regulated flow of air is applied to the mixer 100 via the inlet 112 for admitting the first gaseous fluid (FIG. 1).

On the line 21 for supplying fuel gas at medium pressure, there can be found in succession: a quarter-turn cock 22; a filter 23; a set of electrically controlled safety valves 24 and 25; a pressure regulator 26; and instruments 27 for measuring pressure and temperature. The regulated gas flow is applied to the mixer 100 via the inlet 122 for admitting the second gaseous fluid (FIG. 1).

The outlet from the mixer 100 is fitted with a high pressure pressotat 9 and with an electrically controlled safety valve 8.

The air-gas mixture is available on a line 31 for application to the process that is to fed, such as a set of burners. A module 7 controls the position of the valve members 132, 142 of the sonic nozzles 130, 140 of the mixer 100. The module 7 may be fitted, in particular, with a sensor for sensing the position of the valve members 132, 142.

The pressure regulators 14 and 26 regulate the feed pressures of air and gas applied to the mixer 100 so that they take up the values desired for obtaining the required mixture. A proportional-integral-derivative (PID) type regulator that may be of conventional design is integrated in the module 7 to adjust the position of the valve members 132, 142 in the mixer 100 to the power required by the process.

Adding control means to one or the other of the pressure regulators 14 and 26 or to both of them simultaneously makes it also possible, merely by modifying the pressure initially set for feeding air at medium pressure, or for feeding gas at medium pressure to change the air content of the flame, assuming that reducing or oxidizing atmospheres are required, and this can be done without altering the position of the cone-shaped valve members 132, 142 of the mixer 100.

It may also be observed that by using nozzles 132 and 142 having throats of varying section under sonic operating conditions makes it possible to place high-headloss diffusers at the outlets from the nozzles in the downstream mixing chamber 160, with the shapes of the diffusers supplying turbulence for ensuring that the mixture is uniform. This is achieved without influencing the flow rates and the power of the installation.

The mixer device of FIG. 1 can also be used in the context of supplying a mixture of air and LPG, delivering a mixture of air and of petroleum gas butane, propane, or a mixture of butane and propane) having very accurate proportions so as to obtain a gas whose calorific value is predetermined to a constant value and which can be used as a substitute for natural gas. By way of example, a mixture of approximately 55% propane and 45% air has combustion characteristics that are very similar to those of natural gas for a wide variety of combustion equipment.

Provided compressed air is available at a pressure of more than about 3 bars, the mixer 130 of FIG. 1 can be used, e.g. with additional elements such as those shown in FIG. 3 to receive firstly compressed air from the line 11 and secondly petroleum gas from the line 21, and to output on the line 31 a mixture of air and LPG having predetermined characteristics and at a pressure that may be 2 bars, for example, or less. The mixing ratio and the capacity of the installation are initially defined a priori, by the dimensions of the varying section nozzles 130, 140 and by the feed, pressures available on the air line 11 and on the LPG line 21.

Downstream pressure regulation is performed by -means of the control module 7 which acts on the position of the cone-shaped valve members 132, 142 in the nozzles of the mixer 100.

The control module 7 may include servo-control that is entirely pneumatic, with the two valve members 132, 142 being secured to a direct action or pilot type servo-motor, depending on the accuracy and on the speed of response required for the regulated pressure.

In a variant, the control module 7 may also include other types of regulation which associate PID type regulators with electrical actuators, such as stepper motors or electropneumatic actuators.

A mixer 100 of the invention can also be incorporated in an air/LPG mixer designed for low pressure applications, in the event that a source of compressed air at a pressure greater than 1.3 bars is not available. Under such circumstances, the mixer 100 has the configuration shown in FIG. 2, arid it includes an additional nozzle 170.

Figure 2:
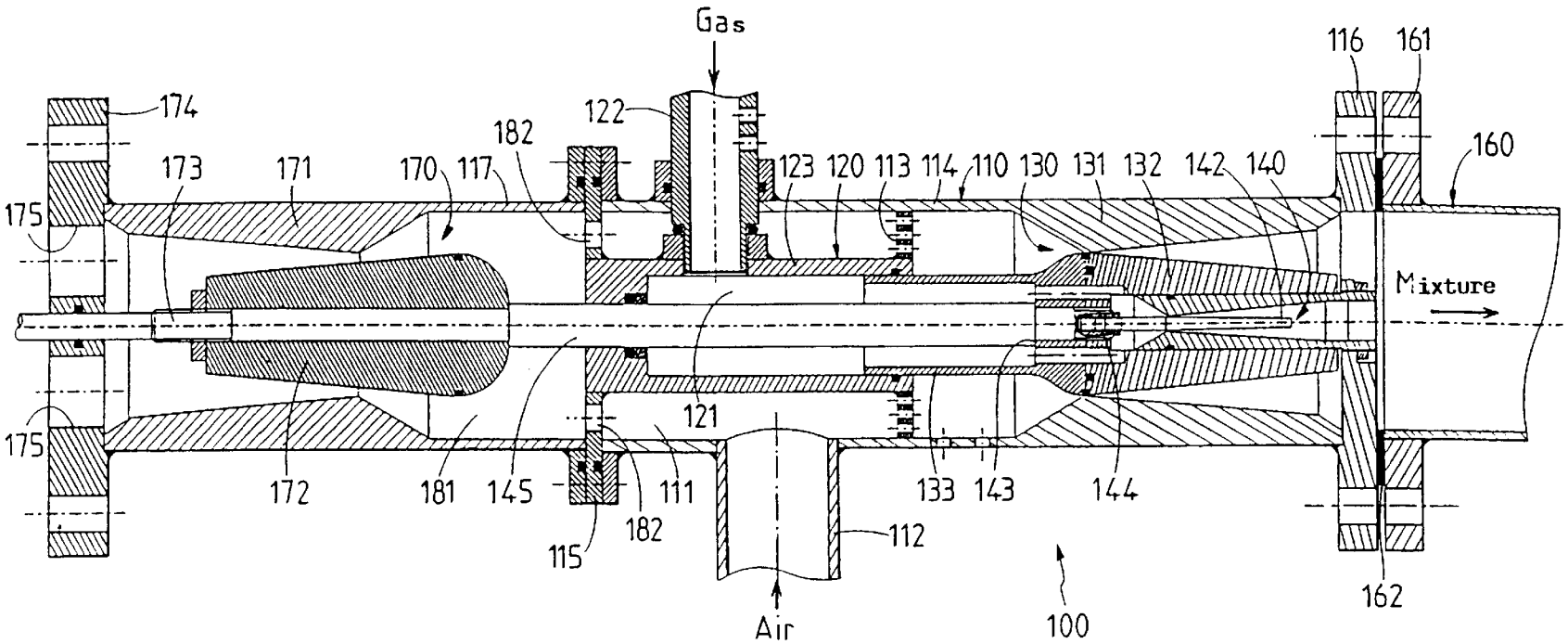
FIG. 2 is an axial section view of a second embodiment of the gas mixer device of the invention, having three sonic nozzles.

In FIG. 2, all elements similar to elements of FIG. 1 are given the same references and they are not described again. In particular, the inlet ducts 112, 122, the coaxial chambers 111, 121, an the nozzles 130, 140 can be made in similar manner in the embodiments of FIGS. 1 and 2.

In the embodiment of FIG. 2, it can be seen that the enclosure 110 is extended beyond tie radial wall 115 by an enclosure portion 117, e.g. in the form of a sleeve connected to the radial wall 115, which enclosure portion 117 defines a third chamber 181 which Communicates, via orifices 182 formed through the radial wall 115, with the first chamber 111. The additional sonic nozzle 170 having a throat of varying section is placed in the chamber 181 and comprises a hollow converging-diverging body of revolution 171 whose geometrical and dimensional characteristics are identical to those of the hollow body 131 of the nozzle 130, but which is disposed in axial alignment with the opposite way round to the hollow body 131, and in a position that is determined relative to the enclosure portion 117 extending the enclosure 110. The hollow body 171 serves as a seat for a one-shaped valve member 172 whose shape and dimensions are identical to those of the first valve member 132.

The valve member 172 is mechanically linked to the valve members 132 and 142 by the control rod 145, but it is the other way round relative to the valve members 132 and 142 such that the sonic nozzle 170 acts antagonistically relative to the first sonic nozzle 130, with the nozzle 170 being in the open position when the nozzle 130 is in the closed position (as shown in FIG. 2), and vice versa.

A terminal part 174 in the form of a flange extends radially from the cylindrical wall of the enclosure portion 117 at its end remote from the wall 115, and downstream from the nozzle 170, and it has orifices 175 such that the surplus air from the nozzle 170 can be exhausted from the enclosure 110, 117.

Figure 4:
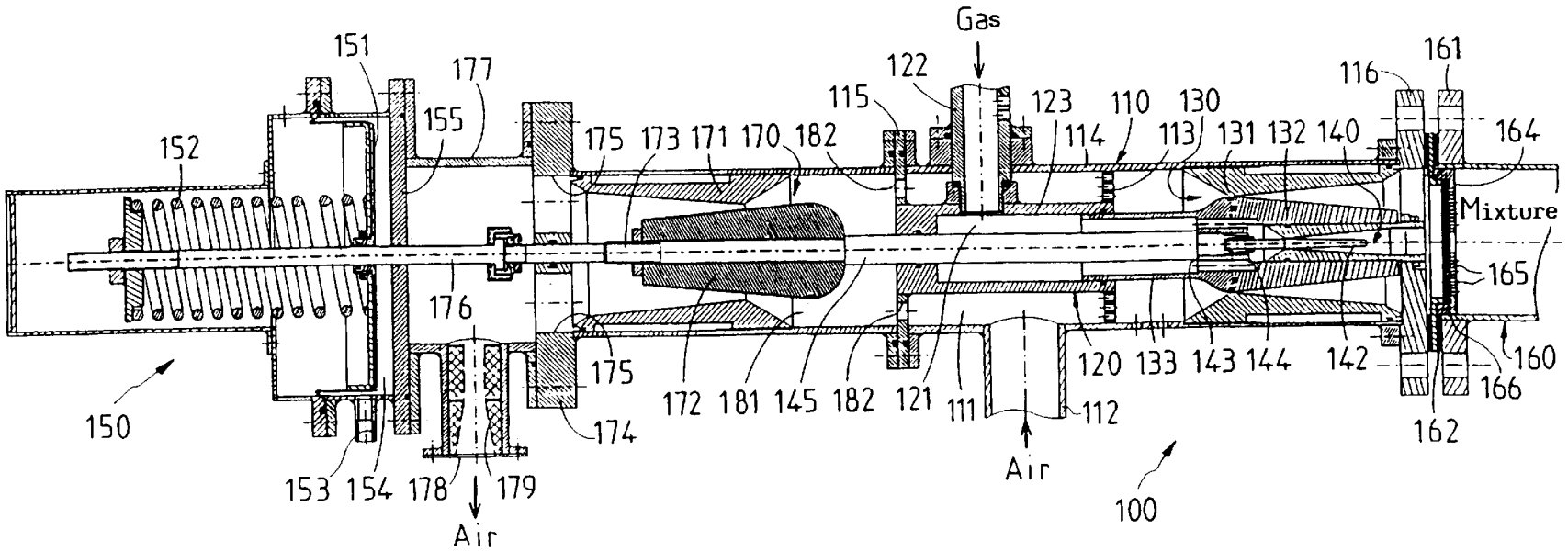
FIG. 4 is an axial section view of a variant of the second embodiment having three sonic nozzles.

The control rod 145 which provides the mechanical linking between the valve members 172 and 132, 142 is extended by an additional rod 173 which passes through the valve member 172, being secured thereto, and also passes in sealed and sliding manner through the end part 174 so as to be connected to an actuator (not shown in FIG. 2) but which may be analogous to the actuator 150 in FIG. 1, and an example of which is shown in FIG. 4.

Implementing a third nozzle 170 acting antagonistically relative to the first nozzle 130 makes it possible for a mixer 100 of the invention in the FIG. 2 configuration to be used with the additional elements shown in FIG. 3 to constitute a generator of an air and LPG mixture in a low pressure application, and when a source of high pressure compressed air is not available. Under such circumstances, it suffices for the centrifugal fan 12 on the air feed line 11 to deliver a minimum pressure of 150 mbar which constitutes the bottom limit for obtaining a sonic flow. It is naturally possible to provide a fan that supplies air at a higher pressure, e.g. 300 mbar, however that increases the consumption of electricity required to operate the fan.

In a mixer 100 having three nozzles 130, 140, 170 whose cone-shaped valve members 132, 142, 172 are secured to one another and constrained to move synchronously, the constant air flow delivered by the fan 12 passes either into the mixing chamber 160, or else into the outlet leading to the atmosphere 175, or, more generally, air passes to both of those destinations whenever the opposing and identically-sized valve members 132 and 172 of the nozzles 130 and 170 occupy an intermediate position.

The feed pressure of the petroleum gas at the inlet duct 122 can be of the order of a few hundred millibars.

The control module 7 has a position sensor for sensing the position of the valve members 132, 142, and 172 in the varying section sonic nozzles 130, 140, and 170. As already mentioned with refernce to FIG. 3, fluid temperature and pressure measuring means 15 and 27 are provided upstream from the chambers 111 and 121, means 9 for measuring the pressure of the air and petroleum gas mixture are provided downstream from the mixer 100, and regulator means act on the pressure regulator 26 for the gas feed source or on a device for positioning the valve members 132, 142, and 172 of the nozzles 130, 140, and 170 to maintain a predetermined downstream pressure for the mixture of air and gas having predetermined calorific value (HCF).

Regulation of the downstream pressure can operate by using servo-control circuits in a manner analogous to that described with reference to an air and LPG mixer based on two nozzles 130 and 140.

A particular advantage which stems; from implementing three nozzles 130, 140, and 170 including the two coaxial nozzles 130 and 140 lies in the fact that the air produced by the fan 12 is subjected to heating which can be recovered directly to promote evaporation of the LPG and avoid the condensation phenomena which are to be found in conventional systems, and which give rise elsewhere to the need to implement heaters for both fluids in order to mitigate this drawback. The coaxial disposition of the nozzles 130, 140 enhances temperature interchange between the air and the LPG. Furthermore, continuously exhausting the air supplied by the fan 12 through one or the other of the two antagonistic nozzles 130 and 170 enables the temperature upstream from the air nozzle 130 to remain stable over time.

With the embodiment of FIG. 2, is with the embodiment of FIG. 1, it is possible to place a silencer-forming device 163 in the mixing chamber 160 at the outlet from the nozzles 130, 140. The nozzle 170 through which air escapes to the atmosphere can also be provided with a silencer 179 which series to reduce noise in the premises where the air and LPG mixer is installed (see FIG. 4).

A gaseous fluid mixer 100 having three nozzles 130, 140, and 170, as shown in FIG. 3, can co-operate with external elements such as those shown in FIG. 3, or can alternatively be implemented in other installations, for example an installation for feeding an air-gas mixture to a burner of a blown-air boiler.

This type of burner is generally fitted to boilers for producing hot water for central heating and rated at a power lying in the range of a few tens of kW to several thousand kW.

The boilers use gas from the utility (natural gas) which is delivered at a pressure of a few hundreds of millibars, e.g. 300 mbar, together with air supplied by a fan at a pressure of a few tens of millibars. These boilers operate in on/off mode (or in on/nearly-off mode) on the basis of fixed settings (low output, high output).

Under such circumstances, a mixer waving three nozzles 130, 140, and 170 as shown in FIG. 2 can be used advantageously with the air being admitted by the duct 112 and the gas being admitted by the duct 122.

The sum of the air flow rates through the opposing first and third sonic nozzles 130, 170 is equal to the constant flow rate of the fan which corresponds to the fully open flow rate of one only of the first and second sonic nozzles 130 and 170, such that for a given power of gas at a nominal flow rate from the feed source, air pressure is regulated automatically.

For a nominal flow rate or a pressure booster of given power, the disposition having two antagonistic nozzles provides automatic regulation of the air pressure which is equal to the looked-for constant value, and this applies to all positions of the valve members 132, 142, and 172 in the mixer 100. Also, given that the pressurized air supplied by the fan to the duct 112 is continuously exhausted, the temperature upstream from the air nozzle remains stable over time.

Because of the stability with which the air is regulated, it is possible with this system to implement modulating power regulation that adapts accurately and progressively to demand. In contrast, in conventional systems, such regulation is performed in on/off mode (or in on/little mode) giving rise to certain kinds of malfunction in the expander/meter station of the distributor (excess pressure on closing, excess metering with certain types of meter that are particularly sensitive to cyclic variations in flow rate, etc.).

FIG. 4 shows a variant embodiment of the gas mixer device described above with reference to FIG. 2.

The variant of FIG. 4 is entirely modular. Thus, the fixed parts 131 and 171 of the nozzles 130 and 170 are not integrally formed with the enclosure 110 as in FIG. 2, but are constituted by separate bodies of revolution that are removable and that are positioned inside the tubular enclosure 110 by means of threaded portions. A mounting of this type for the fixed portion 131 of the nozzle 130 is shown in FIG. 1 for the embodiment having two coaxial nozzles.

In FIG. 4, it can also be seen that the downstream mixing chamber has a transverse plate 164 provided with perforations 165 and supporting a plate 166 of porous material on its front face. The removable assembly 164, 166 is sandwiched between the flanges 116 and 161 and serves to straighten out and regularize the flow of the mixture, preventing vortices being formed while also performing a sound-absorbing function that contributes to reducing the noise generated by expanding the gas. The assembly 164, 166 could equally well be applied to the embodiment shown in FIG. 1, where necessary.

Similarly, a sleeve 177 is applied to the flange 174 and contains a duct 178 allowing air to be exhausted to the atmosphere, which duct is fitted with sound absorbing material 179 advantageously defining a channel whose portion situated close to its outlet is conical in shape and flares outwardly.

FIG. 4 also shows one example of an actuator 150 which incorporates pneumatic type servo-control for acting on an axial rod 176 connected to the additional rod 173.

The pneumatic type actuator 150 shown in FIG. 4 has, for example, a downstream chamber 154 which is in communication via a small feed nozzle 153 with a source of gaseous fluid under pressure and is defined firstly by a fixed rigid transverse plate 155 and secondly by a flexible membrane 151 supported by a rigid plate secured to the axial rod 176 against which a spring 152 acts. Servo-control of the actuator 150 can naturally be more complex or of a kind other than pneumatic servo-control.

What is claimed is:

1. A universal mixer device for mixing two gaseous fluids, wherein:

the device comprises an enclosure iefining first and second coaxial chambers, a first duct opening out into the first chamber to feed it with a first gas at medium pressure, a second duct opening out into the second chamber to feed it with a second gas at medium pressure, a first sonic nozzle having a throat of varying section disposed in the first chamber, and a second sonic nozzle having a throat of varying section disposed in the second chamber;

the first sonic nozzle comprises a first hollow converging-diverging body of revolution serving as a seat for a first cone-shaped valve member, aid the second sonic nozzle comprises a second hollow converging-diverging body of revolution serving as a seat for a second cone-shaped valve member;

the first valve member has an axial bore and defines at least a portion of the first and second chambers;

the second sonic nozzle is disposed inside said axial bore;

the first and second hollow converging-diverging bodies of revolution are of determined positions relative to the enclosure, the first and second valve members are mechanically linked to each other and are connected with a single actuator ensuring synchronized displacement of the first and second valve members; and the first and second gases after passing through the coaxial and geometrically similar first and second sonic nozzles flow axially into a common downstream chamber in which the first and second gases mix in a predetermined mixing ratio determined by the dimensions of the first and second sonic nozzles.

2. A device according to claim 1, wherein:

the device further comprises, inside the enclosure, a third chamber communicating via orifices with the first chamber, and a third sonic nozzle having a throat of varying section disposed in the third chamber;

the third sonic nozzle comprises a third hollow converging-diverging body of revolution identical to said first hollow body of revolution, in axial alignment therewith but extending in the opposite direction thereto in a position that is determined relative to the enclosure, and serving as a seat for a third cone-shaped valve member whose shape and dimensions are identical to those of the first valve member;

the third valve member is mechanic-ally linked to the first and second valve members, but is disposed in the opposite direction relative thereto such that the third sonic nozzle operates antagonistically relative to the first sonic nozzle with the third sonic nozzle being in its open position when the first sonic nozzles is in its closed position, and vice versa; and the third chamber has orifices disposed downstream from the third sonic nozzle enabling surplus first gas from the third sonic nozzle to be exhausted from the enclosure.

3. A device according to claim 1, further comprising a flow straightener disposed in the first chamber upstream from the first sonic nozzle.

4. A device according to claim 1, further comprising an element of sound absorbing material disposed in the downstream mixing chamber.

5. A device according to claim 1, wherein the first gas is constituted by air and the second gas is constituted by a fuel gas selected from a natural gas, propane, butane, and a mixture of propane and butane.

6. A device according to claim 5, wherein the first gas is admitted into the first chamber at a pressure greater than or equal to 1.3 bars, and the second gas is admitted into the second chamber at a pressure greater than or equal to 1.3 bars.

7. A device according to claim 2, wherein the first gas is constituted by air and the second gas is constituted by a fuel gas selected from a natural gas, propane, butane, and a mixture of propane and butane, and wherein the first gas is admitted into the first chamber at a pressure greater than or equal to 150 millibars and the second gas is admitted into the second chamber at a pressure greater than or equal to 1.3 bars.

8. A device according to claim 1, wherein each of the sonic nozzles is made in modular manner and includes a valve member that can be dismounted, thereby enabling the capacity or the mixing ratio of the mixer device to be modified by changing the cone angle of the valve member.

9. An installation for feeding an industrial process including a set of multiple burner furnaces for heat treatment with a mixture of air and gas, wherein the installation comprises: a source for feeding air at medium pressure comprising a fan and a pressure regulator; a source for feeding fuel gas comprising a line for feeding gas at medium pressure on which there are disposed a filter; at least one electrically controlled safety valve; a pressure regulator; a universal mixer device according to claim 1 whose first and second chambers; are connected respectively to the air feed source and to the fuel gas feed source, and an electrically controlled safety valve disposed at the outlet from the universal mixer device.

10. An installation according to claim 9, comprising at least one control means acting on at least one of the pressure regulators to change the air content of the flame merely by modifying the initially fixed pressure for the medium pressure air feed or the medium pressure gas feed.

11. An installation for feeding a burner of a blown-air boiler with an air-gas mixture, wherein the installation comprises:

a universal mixer device according to claim 2;

a source for feeding gas at a pressure of the order of a few hundred millibars, connected to the second chamber of the mixer device; and a source for feeding air at a pressure of the order of a few tens of millibars, comprising a fan and connected to the first chamber of the mixer device, which first chamber is itself in communication with the third chamber;

whereby the sum of the air flow rates through the first and second antagonistic sonic nozzles is equal to the constant flow rate from the fan which corresponds to the flow rate through one or other of the first and third sonic nozzles when fully open, thus ensuring that for given power of a nominal flow rate from the gas feed source, the air pressure is regulated automatically.

12. A generator for generating a mixture of air and petroleum gas having predetermined constant calorific value, wherein the generator comprises:

a universal mixer device according to claim 1;

a source for feeding petroleum gas at a pressure of the order of a few bars, which source is provided with a pressure regulator and is connected to the second chamber of the mixer device;

a source feeding air at a pressure of the order of a few bars, which source is provided with a pressure regulator and is connected to the first chamber of the mixer device;

a position sensor for sensing the position of the first and second valve members of the first and second sonic nozzles;

means for measuring the temperature and the pressure of the fluid upstream from the first and second chambers;

means for measuring the pressure of the mixture of air and petroleum gas downstream from the mixer device; and regulator means acting on the pressure regulator of the gas feed source or on the device for positioning the first and second valve members of the first and second nozzles to maintain a predetermined downstream pressure for the mixture of air and gas of predetermined calorific valve.

13. A generator for generating a mixture of air and petroleum gas of predetermined constant calorific value, wherein the generator comprises:

a universal mixer device according to claim 2;

a source for feeding petroleum gas at a pressure of the order of at least a few hundreds of millibars, which source is provided with a pressure regulator and is connected to the second chamber of the mixer device;

a source for feeding air at a pressure of the order of at least 150 millibars, which source is provided with a pressure regulator and is connected to the first chamber of the mixer device, itself in communication with the third chamber of the mixer device;

a position sensor for sensing the position of the first, second, and third valve members of the first, second, and third sonic nozzles;

means for measuring the temperature and the pressure of the fluid upstream from the first and second chambers;

means for measuring the pressure of the mixture of air and petroleum gas downstream from the mixer device; and regulator means acting on the pressure regulator of the gas feed source or on the device for positioning the first, second, and third valve members of the first, second, and third nozzles to maintain a predetermined downstream pressure of the mixture of air and gas of predetermined calorific value.

* * * * *